United States Patent [19]

Ventz

[11] 4,049,259

[45] Sept. 20, 1977

[54] METHOD OF AND APPARATUS FOR FEEDING SHEETS

[75] Inventor: George A. Ventz, Clifton, N.J.

[73] Assignee: General Corrugated Machinery Co., Inc., Palisades Park, N.J.

[21] Appl. No.: 711,479

[22] Filed: Aug. 4, 1976

[51] Int. Cl.[2] ..... B65H 1/30

[52] U.S. Cl. ..... 271/151; 271/3.1; 214/6 C; 214/6 D; 214/8.5 A

[58] Field of Search ..... 271/3.1, 149–151; 198/443; 214/1 Q, 1 QA, 6 C, 6 D, 7, 8.5 A

[56] References Cited

U.S. PATENT DOCUMENTS

| | | | |
|---|---|---|---|
| 3,201,114 | 8/1965 | Swartz et al. | 271/150 X |
| 3,422,969 | 1/1969 | Miller et al. | 271/3.1 UX |
| 3,459,420 | 8/1969 | Huntwork | 271/150 |
| 3,881,718 | 5/1975 | Fernandez-Rana et al. | 271/150 X |

*Primary Examiner*—Robert W. Saifer
*Attorney, Agent, or Firm*—Samuelson & Jacob

[57] ABSTRACT

Method and apparatus wherein flat corrugated paperboard sheets in stacks are rearranged into a horizontally shingled array of the desired faced orientation and fed toward an exit in the apparatus, each stack being fed onto a conveyor, then tilted to a first posture wherein the sheets are not yet in the horizontally shingled array, but are supported with their edges resting on the conveyor and with their faces making an acute angle with the conveyor, the sheets then being moved toward the exit while supported on their edges in the first posture, and then being dropped from the first posture into a second posture, wherein the sheets are in the shingled array, and into juxtaposition with shingled sheets of a previous stack on the conveyor for establishing a flow of continuously shingled sheets toward the exit.

32 Claims, 2 Drawing Figures

METHOD OF AND APPARATUS FOR FEEDING SHEETS

The invention relates to a method of and apparatus for feeding sheets such as corrugated case blanks. More particularly, the invention is directed toward accepting a stack of horizontal sheets and delivering them as a continuous flow of shingled horizontal sheets in a desired faced orientation to a hopper, other receptacle or the input of a further machine.

Various constructions have been disclosed in the prior art for operating upon a stack of horizontal sheets to accomplish the purpose of the method and apparatus described herein. One of the earliest of such disclosures is contained in U.S. Pat. No. 3,422,969, issued Jan. 21, 1969, which is owned by the assignee hereof. Since that patent issued and other work in the field was done by the assignee hereof and others, it became evident that certain additional improvements were needed in order to obtain the high performance necessary for economical commercial operation on a production line. Moreover, the prior art machines could not maintain the speed of the unit to which it was feeding the sheets. Obviously, if the feeding speed is materially lower than the speed of the following unit, the subsequent unit will be operating inefficiently as it will have some "down" time while it waits for more sheets. If the speed of the second unit is slowed down to match the feed speed, there is an equivalent of "down" time because the unit is not operating at its highest and most efficient speed.

It has been found that in prior art machines, one obtains clumps of sheets which do not feed evenly if the leading sheets from a subsequent stack do not properly contact the trailing sheets from the previous stack. As a consequence, manual control of the feed must be exercised from the time a stack of horizontal sheets enters the apparatus until the sheets are delivered at the exit.

Another difficulty with the prior art apparatus arises when the sheets are deposited on the conveyor so that they do not shingle properly and become misaligned in the transverse dimension of the machine. In either of the above described cases, it is necessary for the machine operator to straighten the sheets out by hand. While this may appear an appropriate technique for solving the problems, it is uneconomical, time consuming and perhaps inviting of accidents. Too often, operating personnel become impatient and, as a consequence, take some careless action because of their frustration with the less then perfect operation of the machine. It is very important that the sheets of a following stack shingle onto the trailing sheets of the preceding stack in order to obtain smooth, efficient operation. A continuous shingling of the sheets from a stack to a successive stack is vital to the successful operation of the apparatus. If this is not accomplished automatically and regularly, operator attention is required at the beginning and end of the processing of each stack. For commercial success, the apparatus must be as free of operator assisted operation as possible.

The method of and the apparatus for feeding sheets of the instant invention are directed toward overcoming the inherent difficulties of the prior art methods and devices. In particular, the invention is directed toward obtaining a smoothly operating efficient result with a minimum of manual operation.

Broadly, the invention provides for receiving a stack of horizontal sheets and holding the stack at the entrance until the conveyor is ready to receive it. When a first predetermined condition is met, the stack is fed onto the conveyor and is placed so that the individual sheets rest on their edges and will be in the desired faced orientation at the exit. The faces of the edge resting sheets form an acute angle with the conveyor and are held in this position until a second predetermined condition is reached. At that time, the sheets are pushed forward so that the leading sheet contacts the trailing sheet of the previous stack of sheets. The sheets now drop onto the conveyor to deliver them in shingled fashion to the exit. Frequently, the sheets are collected in a magazine but they may be delivered to any other device such as the input of a printer-slotter or other machine.

It is an important object of the invention to provide a method of and apparatus for delivering a continuous flow of sheets at the exit in a desired faced orientation with a minimum, ideally no, operator attention.

It is a further object of the invention to provide a method of and means for delivering a stack of horizontal sheets to the entrance at a first predetermined condition.

It is another object of the invention to provide a method of and means for supporting the sheets on their edges until a second predetermined condition is reached.

It is a still further object to move the edge resting sheets so that its leading sheet is in contact with the trailing sheet of the previous stack when the second predetermined condition is reached.

These and other objects, advantages, features and uses will be apparent during the course of the following description when taken together with the accompanying drawing wherein:

FIGS. 1–6 are diagrammatic, side elevational views of various steps in the operation of one embodiment of the invention;

FIGS. 7 and 7A, joined on the lines A—A, together are a side elevational view of the embodiment of FIGS. 1–6;

Figure 15:
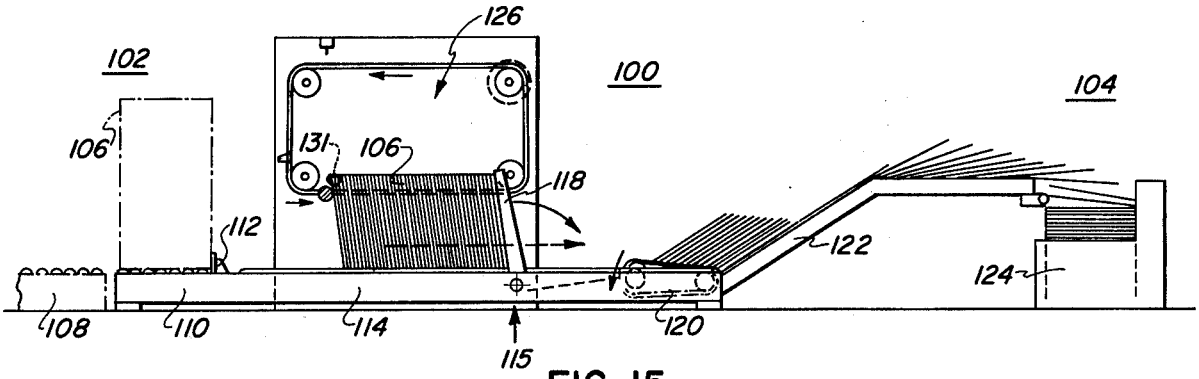
Figure 16:
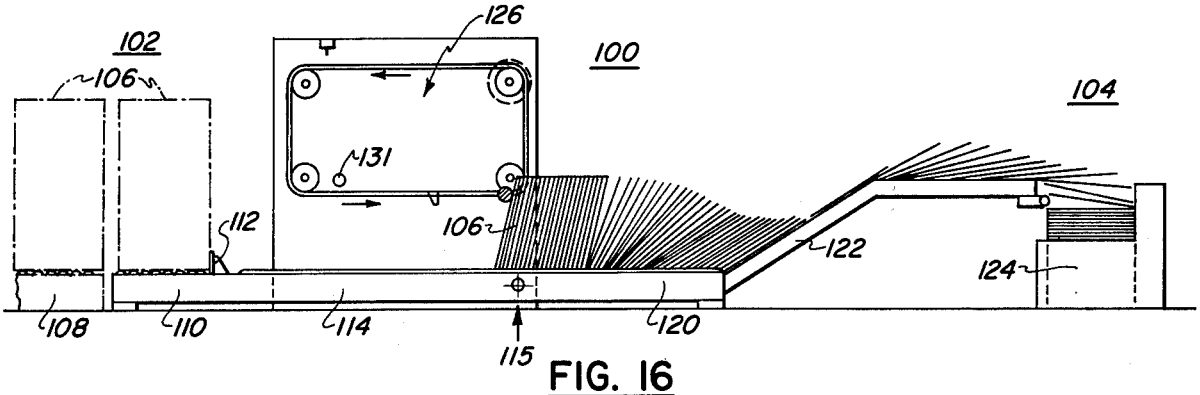
Figures 17, 17A:
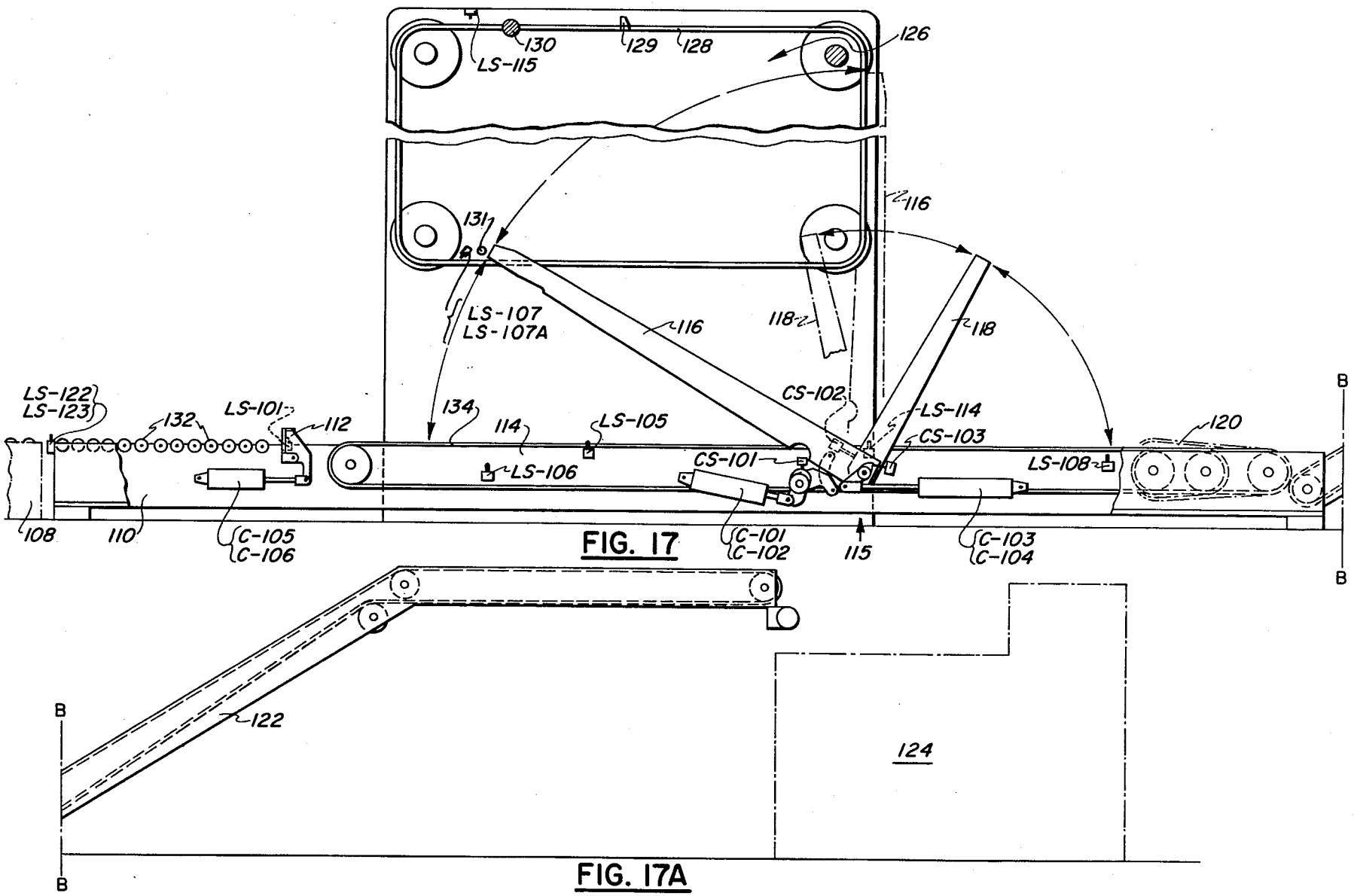
Figure 18:
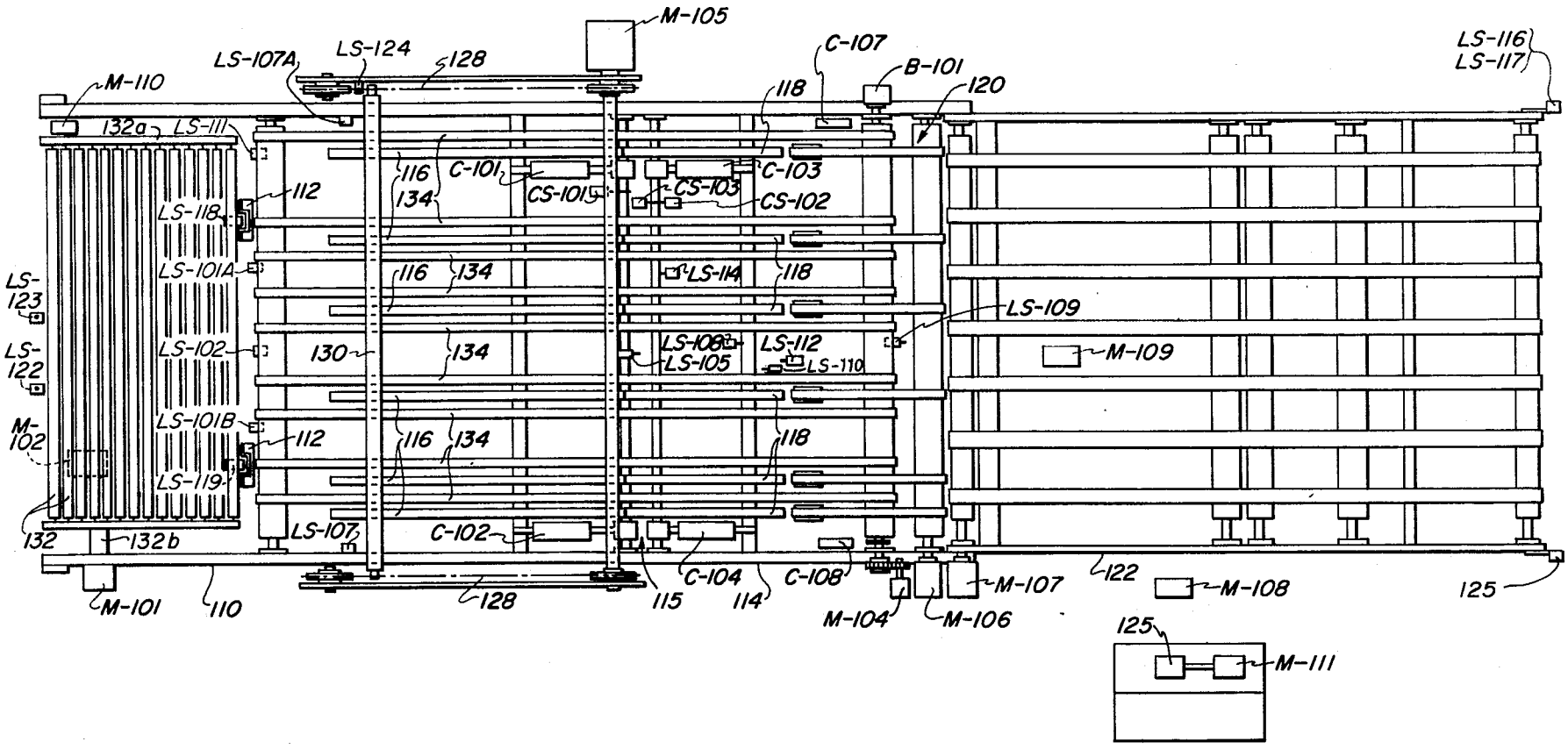
Figure 19:
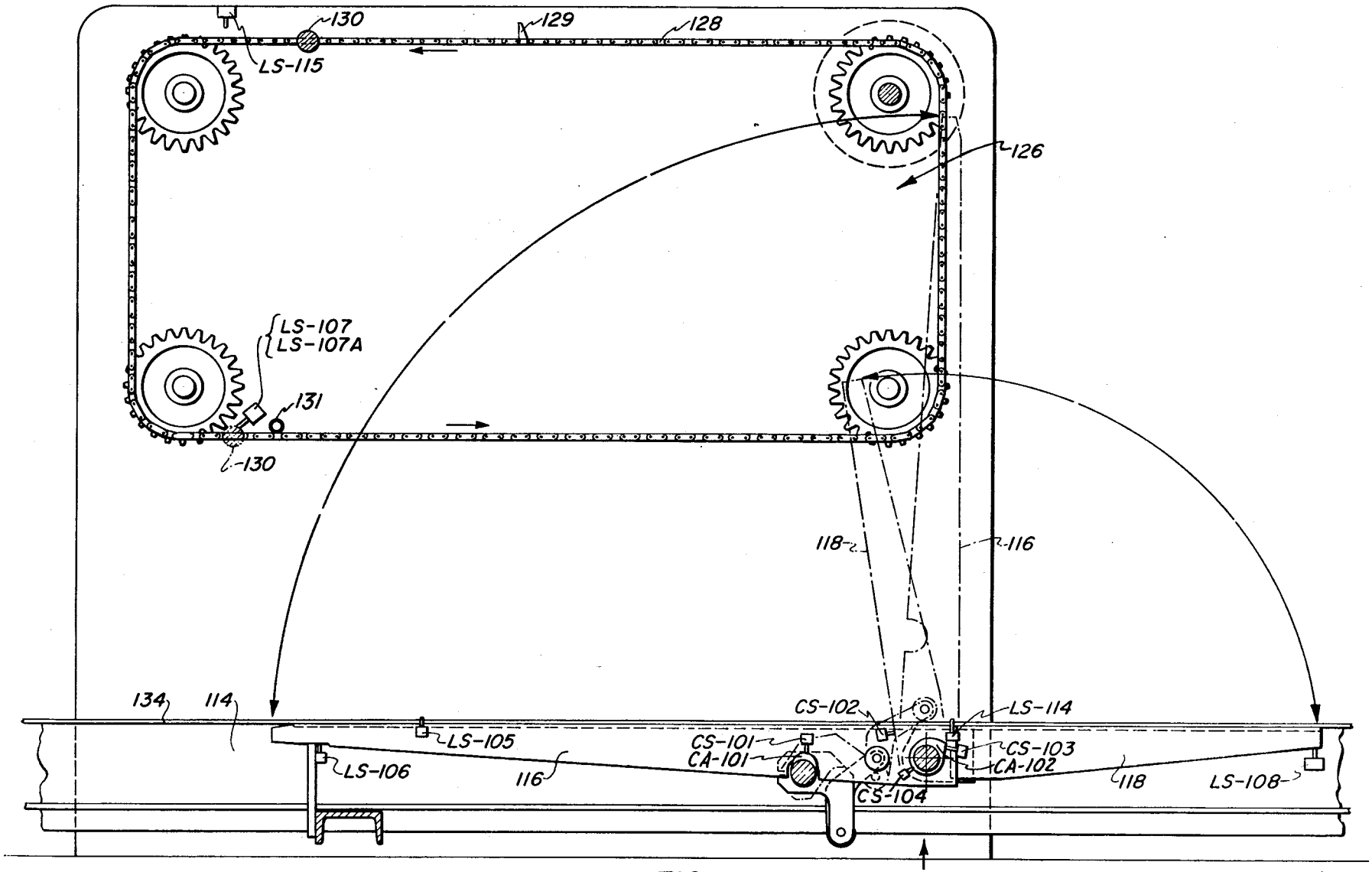
Figure 20:
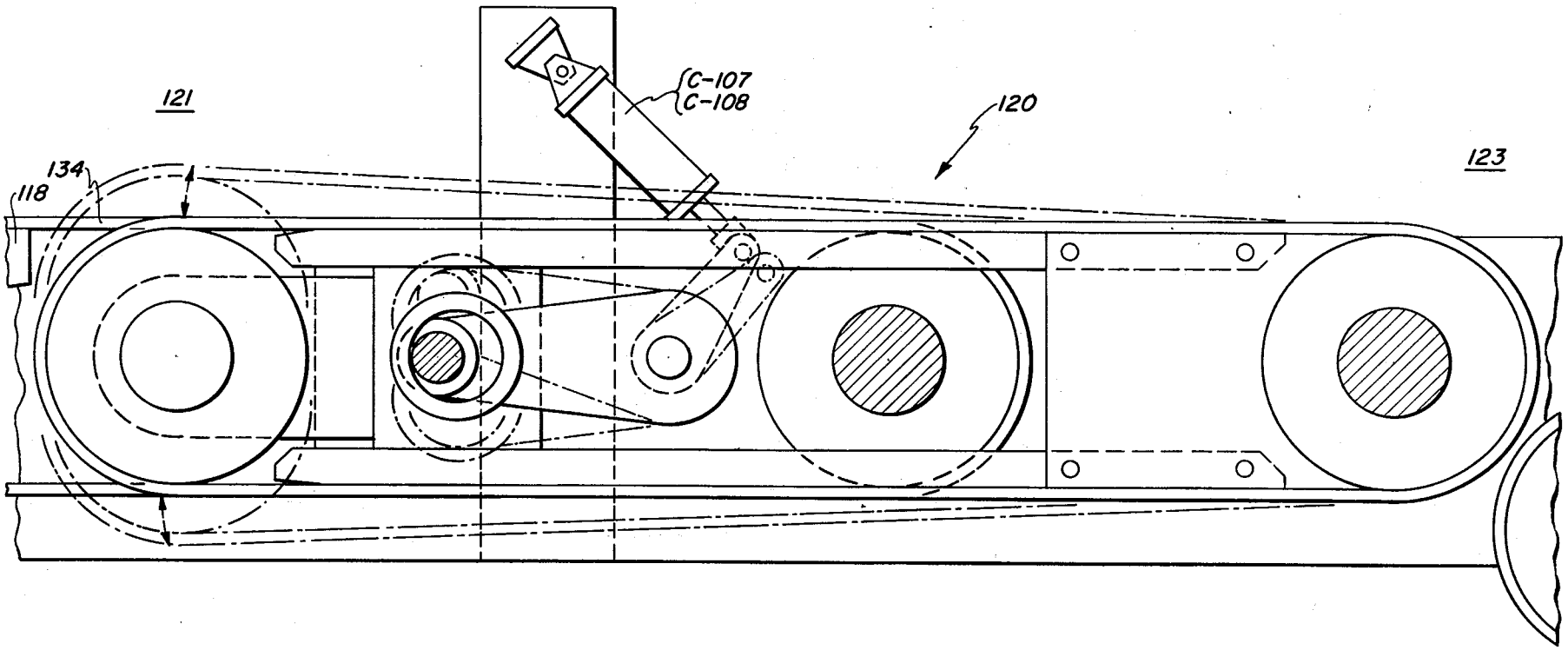

FIGS. 17 and 17A, joined on lines B—B, together are a side elevational view of the embodiment of FIGS. 13–16;

FIG. 18 is a horizontal plan view of the embodiment of FIGS. 13–16;

FIG. 19 is an enlarged side elevational view of the main conveyor, showing the support bar mechanism; and FIG. 20 is a view, similar to that of FIG. 19, of the short intermediate conveyor section, showing the three positions of its entrance end.

In the drawing, wherein, for the purpose of illustration, are shown two embodiments of the apparatus of the invention and wherein, like numerals designate like parts throughout the same, the numeral 30 designates an apparatus or machine of the invention, generally. Machine 30 is provided with an entrance or entrance end 32 and an exit or exit end 34.

A customer's conveyor 38 is adjacent the entrance end 32 which is provided with an infeed conveyor 40. The infeed conveyor 40 utilizes a gate or stop 42 to preclude movement of a stack 36 of horizontal sheets beyond the infeed conveyor until the machine is ready for it.

Two sets of orienting slats or forks 46 and 48 are associated with main conveyor 44 and are located at the upsetting position 43. In the particular embodiment illustrated, the longer (or inner) forks 46 contact the edges of the sheets and the shorter (or outer) forks 48 contact the face of the bottom sheet. In some machines, in which very large sheets are processed, outer forks 48 may be equal in length or longer than inner forks 46. Moreover, while the particular embodiments of the invention described and shown herein are used to deliver the sheets at the exit in the same faced orientation in which they enter the machine, the invention is equally useful on machines in which the faced orientation of the sheets is reversed in the apparatus.

Figure 1:
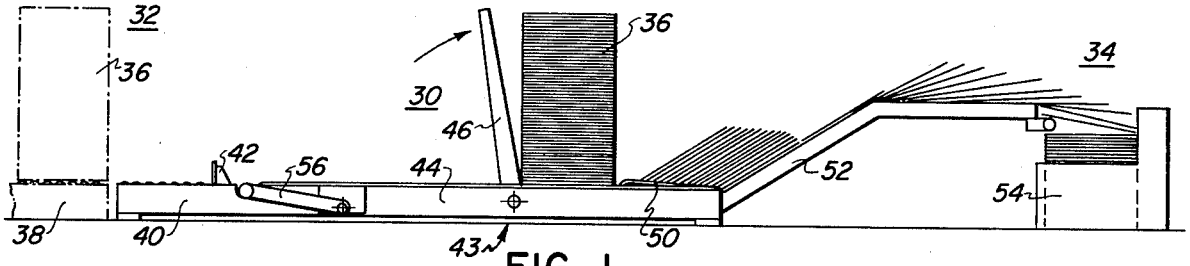
Figure 2:
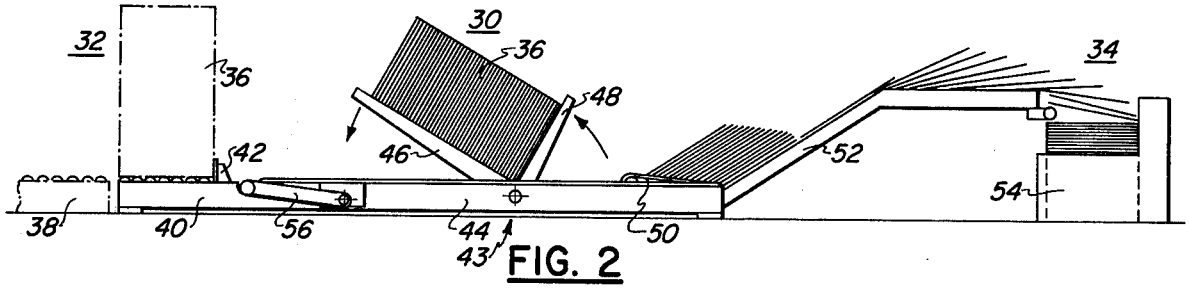
Figure 3:
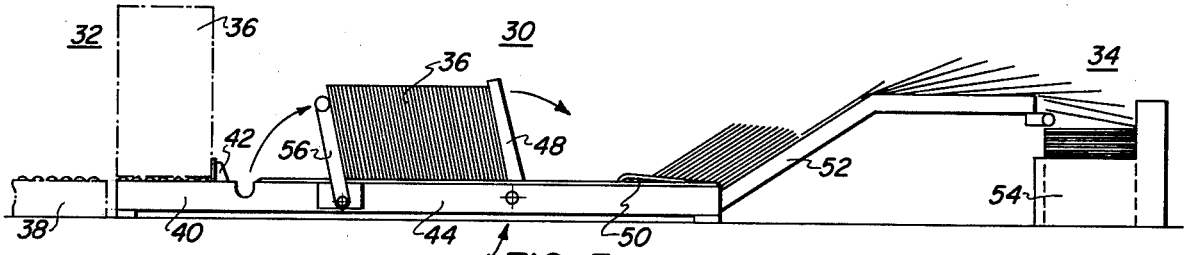
Figure 4:
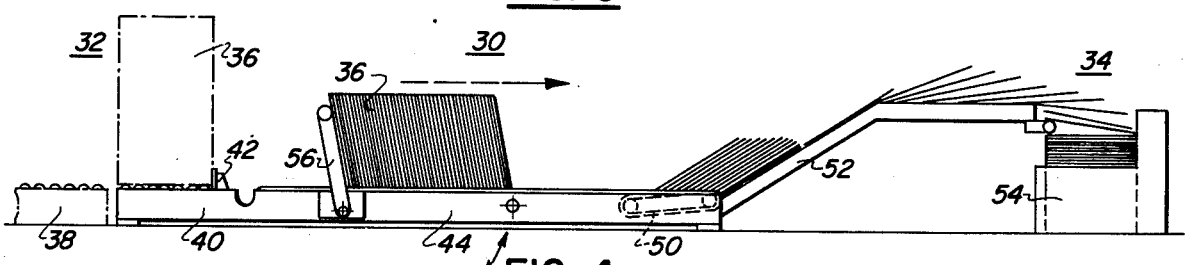
Figure 5:
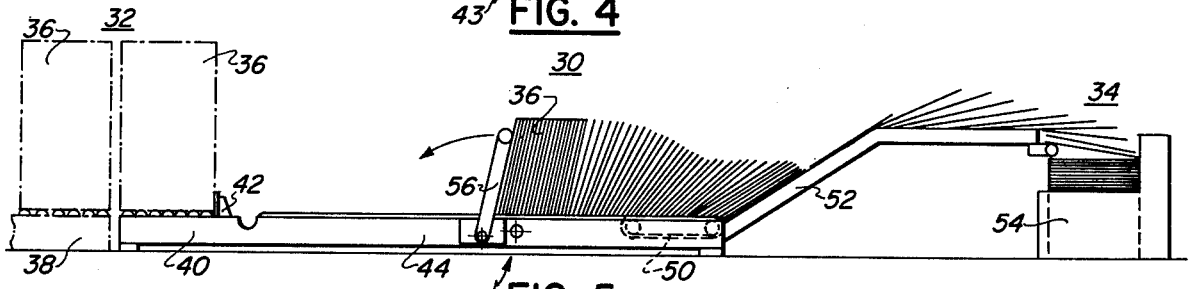
Figure 6:
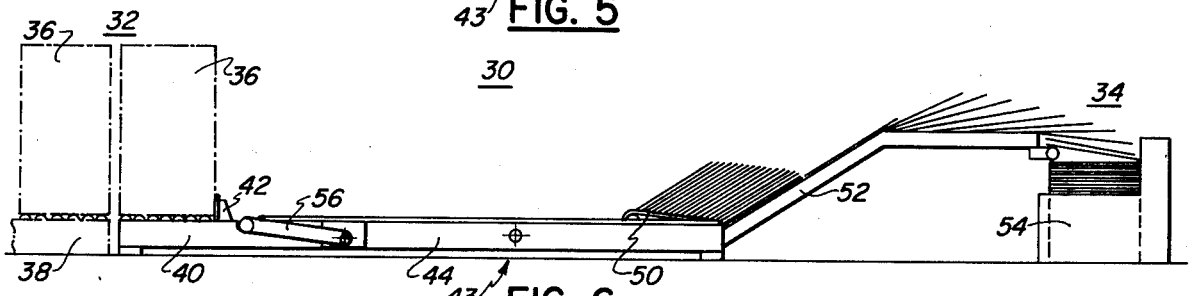

Interleaved with main conveyor 44, there is a short intermediate conveyor section 50 which is movable among three positions. In the position shown in FIGS. 1–3 and 6, the entrance to conveyor section 50 is raised to thereby preclude the entry of any sheets onto it. In the position shown in FIG. 4, the entry end is below the level of main conveyor 44 to permit the sheets to be shoved onto the conveyor section 50 rapidly. In the position of FIG. 5, the conveyor section 50 is aligned with main conveyor 44 to permit a smooth flow of sheets from the main conveyor 44 through conveyor section 50 onto an inclined conveyor 52 and then to a hopper 54 which is one example of a terminus of the exit end 34.

In order to improve the operation of machine 30 and avoid clumping and gapping and to prevent the leading sheets of a stack from falling flat onto the conveyor, it is advisable to support the sheets on their edges on the main conveyor 44. This is accomplished by placing a support mechanism 56 against the face of the sheet at one end of the group. The support mechanism 56 contacts the sheet at the end at which the face of the sheet and the conveyor form an acute angle. While in the embodiments of this invention, the acute angle faces toward the entrance end 32, it is also possible to carry out the teachings of the invention with the acute angle facing the exit end 34.

Now that the method of the invention and the machine of one embodiment thereof has been described in broad terms, one may proceed to a detailed description of the construction and operation of the machine 30.

Figure 7:
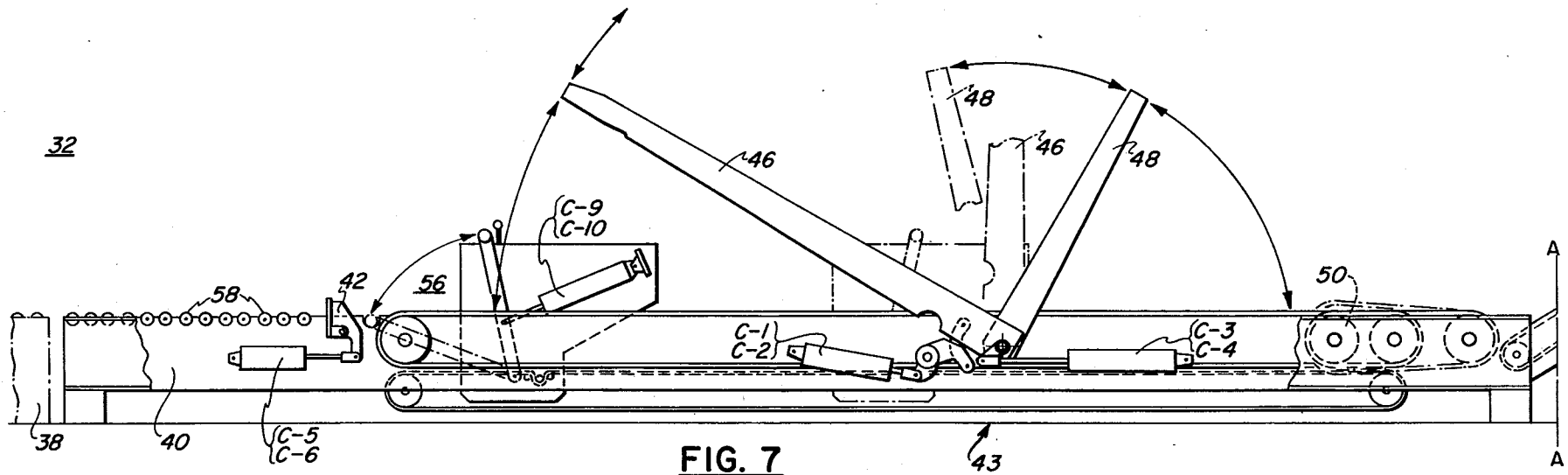
Figure 7A:
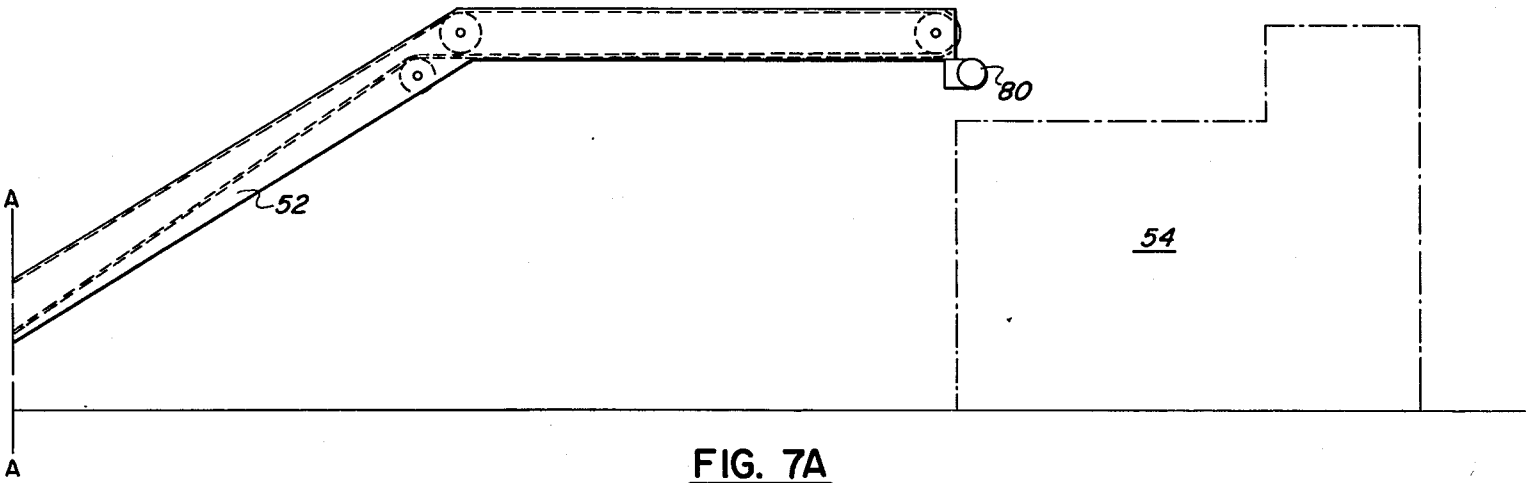
Figure 8:
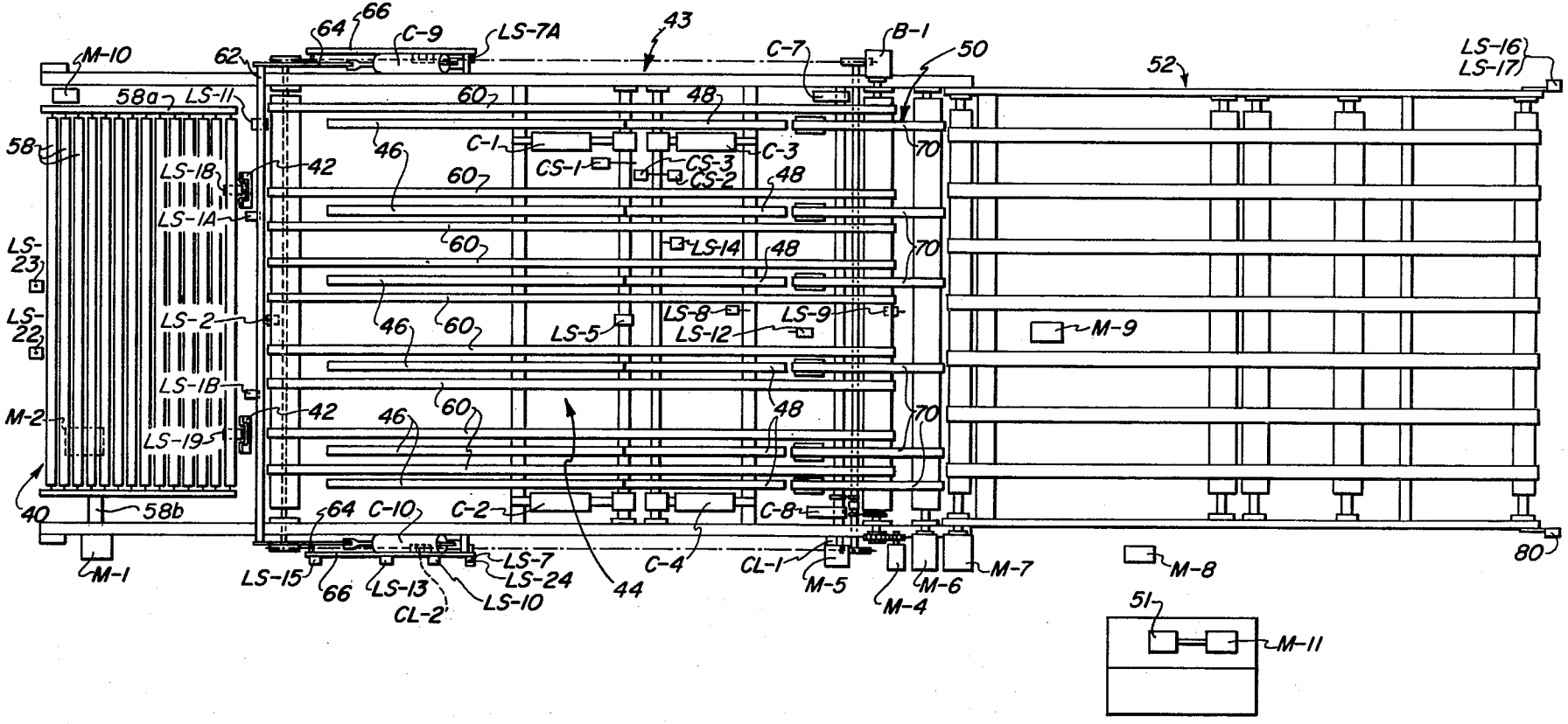
FIG. 8 is a horizontal plan view of the embodiment of FIGS. 1–6.
Figure 9:
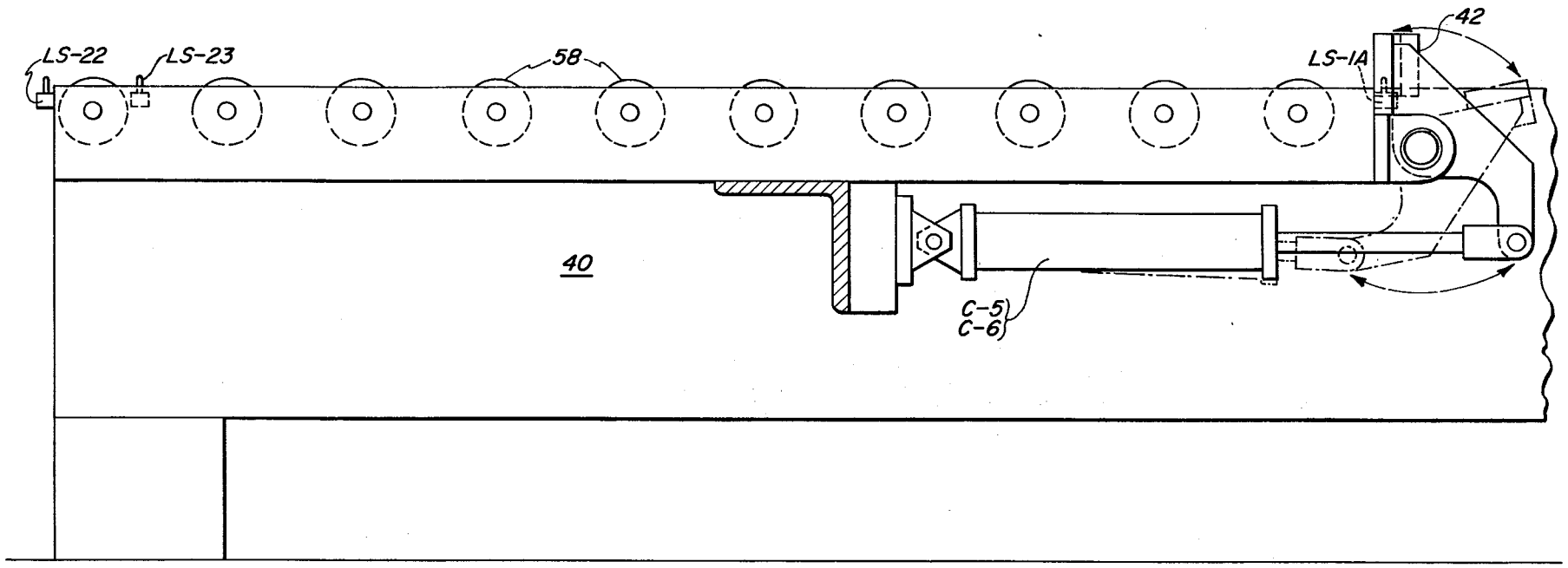
FIG. 9 is an enlarged, side elevational view of the entrance end of the embodiment of FIGS. 1–6.
Figure 10:
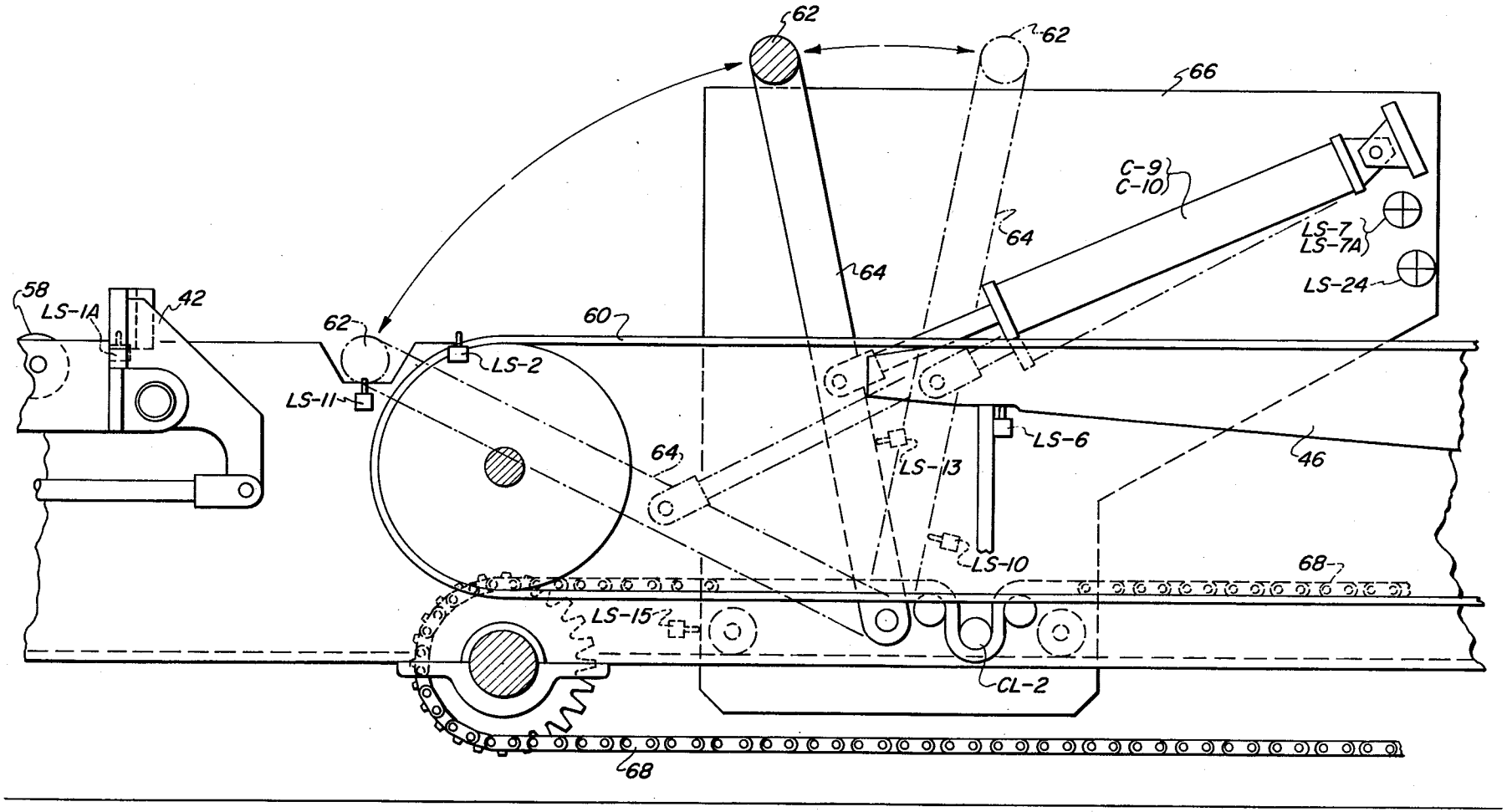
FIG. 10 is a view similar to that of FIG. 9 of the exit portion of the entrance platform and the entrance of the main conveyor, showing the support bar actuating mechanism.
Figure 11:
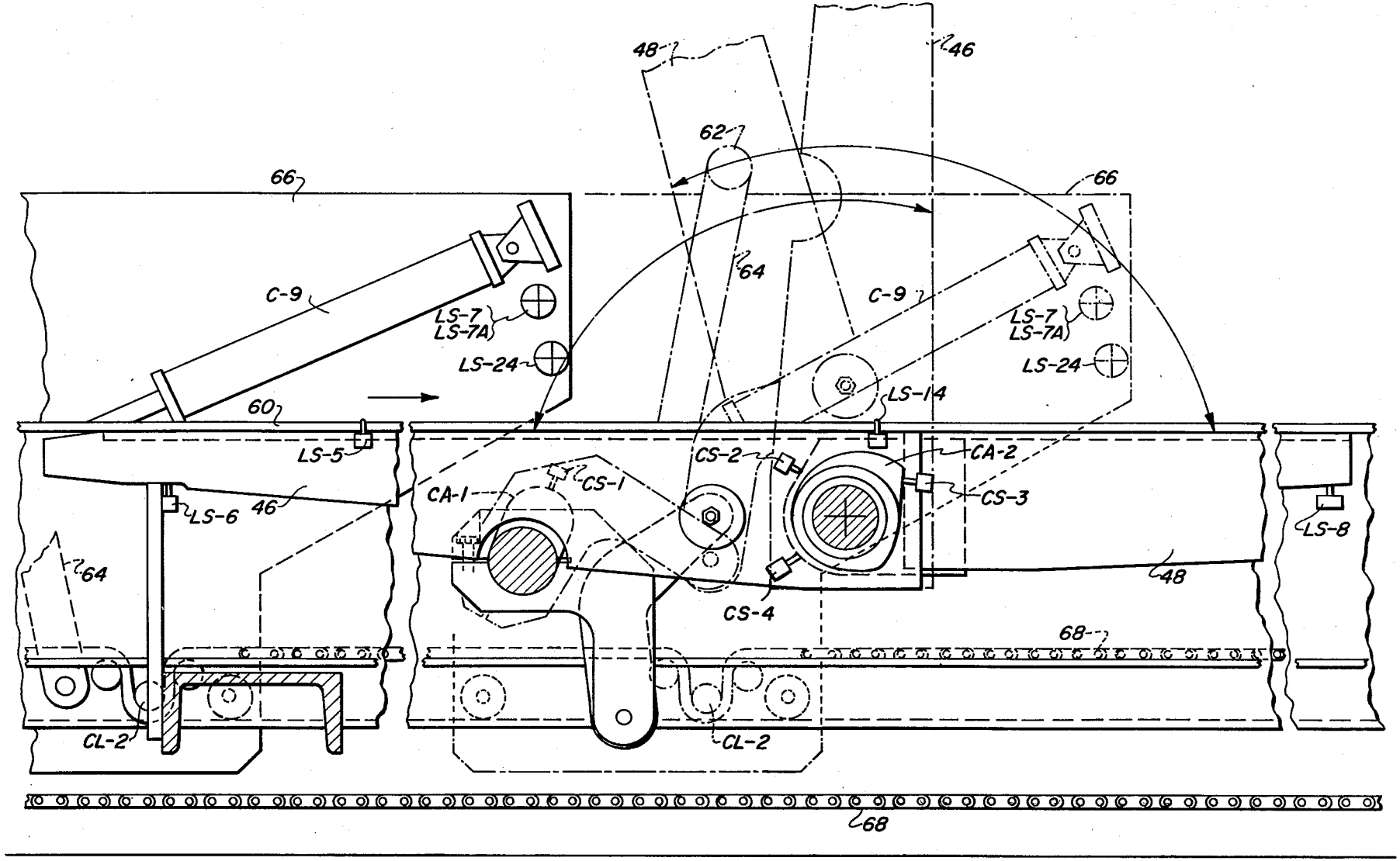
FIG. 11 is a view, similar to that of FIG. 9, showing the operating elements associated with the main conveyor.
Figure 12:
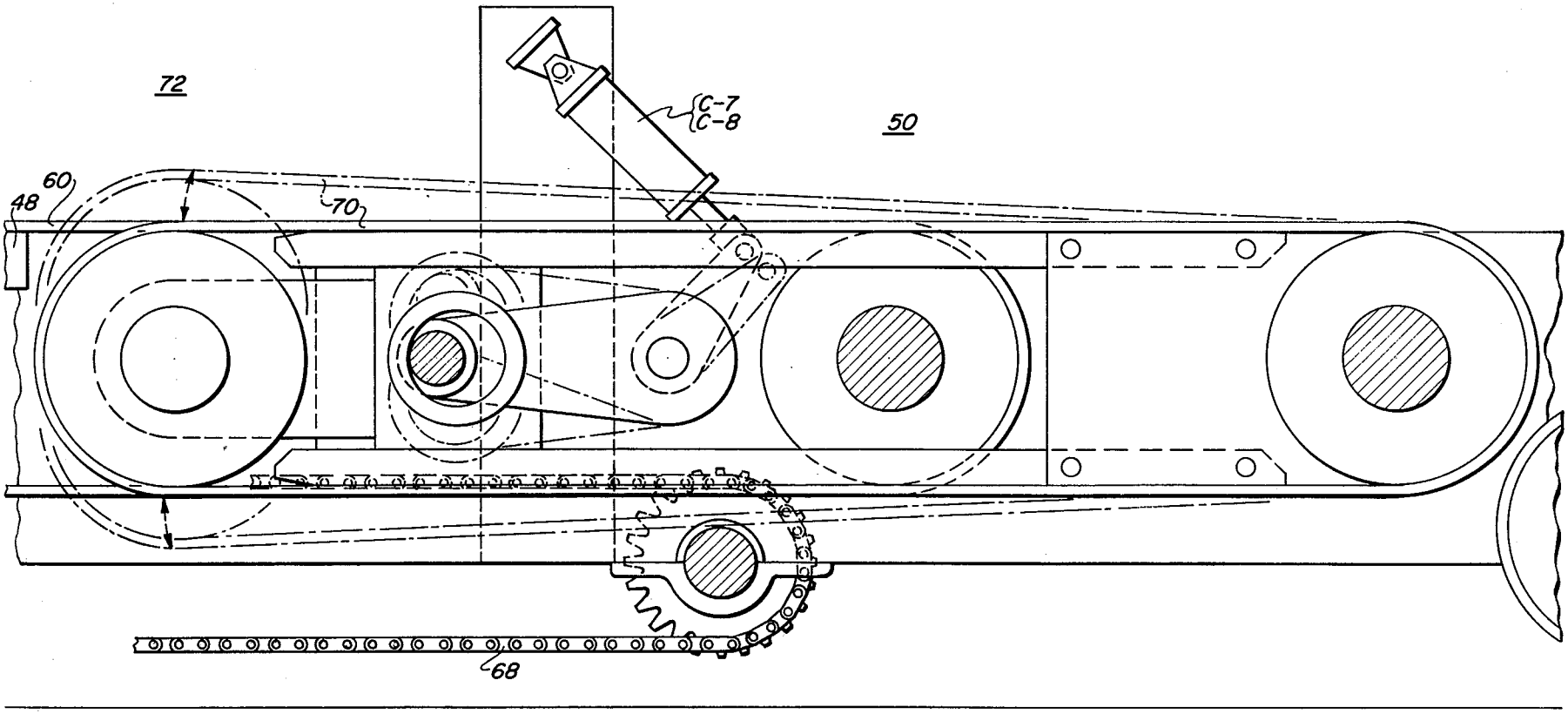
FIG. 12 is a view, similar to that of FIG. 9, of the short intermediate conveyor section, showing the three positions of its entrance end.
Figure 13:
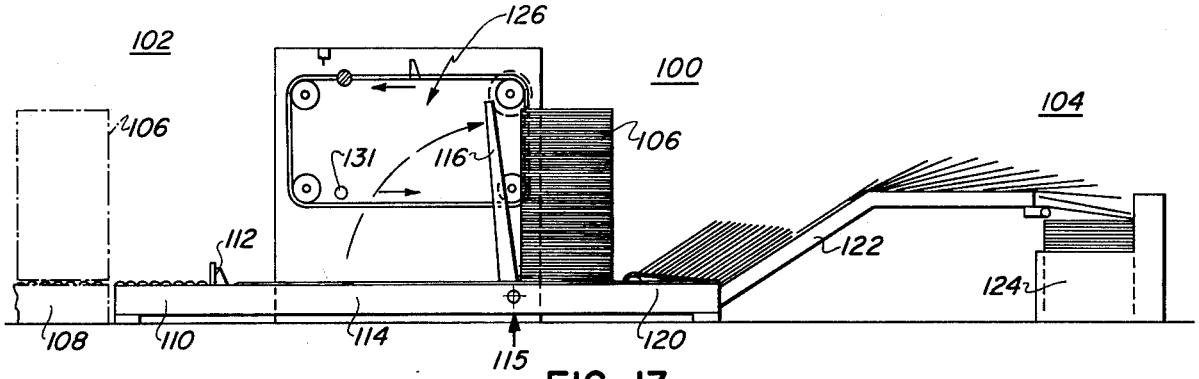
FIGS. 13–16 are diagrammatic, side elevational views of various steps in the operation of a second embodiment of the invention.
Figure 14:
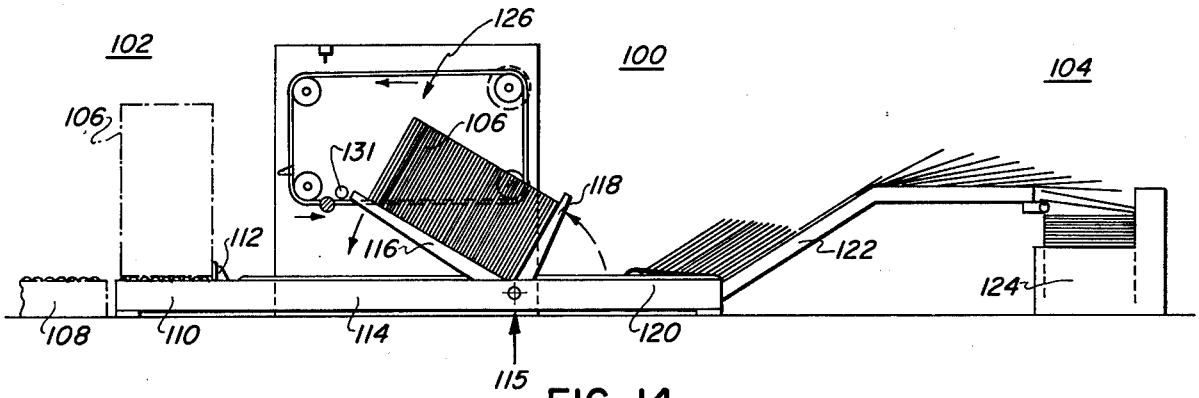

FIGS. 7 and 7A, joined on line A—A, together are a side elevational view of machine 30 and FIG. 8, to a smaller scale, is a plan view thereof. The customer's conveyor 38 is shown at the same level as infeed conveyor 40. Preferably, they should be at the same level but the apparatus of the invention will operate with equal efficiency if the infeed conveyor 40 is capable of moving between the level of the customer's conveyor 38 and the main conveyor 44 to thereby facilitate transfer of stacks to the entrance of the machine. The conveyor referred to herein as the "customer's conveyor" is intended to designate the existing materials handling system already in the plant as a contradistinguished from the apparatus of the invention.

As a predetermined condition is reached, stops 42 drop to permit a stack of horizontal sheets to move from infeed conveyor 40 onto main conveyor 44. An infeed conveyor motor M-2 drives rollers 58 of infeed conveyor 40. If no stack of sheets is on infeed conveyor 40 and a stack is driven to it on the customer's conveyor 38, the stack is detected by limit switch LS-22 and is permitted to enter onto infeed conveyor 40. When LS-22 is actuated, motor M-2 starts and drives rollers 58 to move the stack onto infeed conveyor 40. As the trailing edge of the stack leaves the customer's conveyor 38, it contacts limit switch LS-23 and turns off customer's conveyor 38.

The stack moves forward until the leading edge contacts at least one of the stops 42 and the switches LS-1A and LS-1B. When both limit switches LS-1A and LS-1B are contacted, thereby squaring the stack to the gates or stops 42, the customer's conveyor 38 is signalled to start and the next stack is brought up to limit switch LS-22. The conveyor 38 then stops. The making of limit switches LS-1A and LS-1B also stops infeed conveyor motor M-2. Sensors LS-18 and LS-19 are manually adjustable for various stack widths, are located directly in front of gates 42 and sense the transverse position of the stack. If the stack is off-center, motor M-1 is started and moves infeed conveyor 40 transversely so that the stack will be properly aligned with the main conveyor 44. To this end, rollers 58 are carried by a subframe 58*a* which is coupled to motor M-1 for transverse movement of the infeed conveyor 40 relative to main conveyor 44 by means of a drive arrangement 58*b*. When the proper alignment is reached, motor M-1 stops.

Now, gates 42 drop and infeed conveyor motor M-2 starts and dual speed, main conveyor motor M-4 starts at its slow speed. This action moves the stack off infeed conveyor 40 onto main conveyor 44. After the trailing edge of the stack leaves infeed conveyor 40, limit switch LS-2 opens and gates 42 rise to the stop position actuated by cylinders C-5 and C-6 and motor M-2 stops. Infeed conveyor 40 is now ready for the next stack of sheets.

The first stack of sheets proceeds along the belts 60 of conveyor 44 until its trailing edge leaves limit switch LS-5. At this time, motor M-4 stops and aided by brake B-1, the conveyor 44 stops. This position 43 is referred to as the uppsetting position. The inner forks actuated by cylinders C-1 and C-2 are raised to eventually make contact with the rear of the stack. Limit switch LS-14 is closed to detect stack upset.

As the inner forks 46 reach an angle of about 75°, cam switch CS-1, which coacts with cam CA-1, closes. This actuates cylinders C-3 and C-4 and starts outer forks 48 upward against the bottom of the stack and starts retraction of the inner forks 46. When the outer forks 48 reach an angle of about 45°, cam switches CS-2 closes and the outer forks 48 stop while the inner forks 46 continue to retract. When inner forks 46 are fully retracted, limit switch LS-6 closes.

When limit switch LS-6 closes, cylinders C-9 and C-10 are actuated to move support means 56 upward toward the stack which is leaning against outer forks 48 and whose front faces form an acute angle with the conveyor so that the actute angle is toward the exit 34. Support means 56 comprises a support bar 62 and a pair of arms 64 which hold the bar 62. The arms 64 are pivotably mounted to a pair of transversely spaced plates 66.

When support means 56 reaches an upright position, limit switch LS-13 is closed thereby energizing clutch CL-1 and motor M-5. Clutch CL-1 engages drive chain 68 which moves support means 56 and side plates 66 towards exit end 34. The support means 56 moves forward until the photocell system LS-7 and LS-7A detects the trailing edge of the stack. When this occurs, the motor M-5 stops and clutch CL-1 is disengaged. Outer forks 48 continue to move upward until the stack is upset and rests against the support bar 62. In this position, the faces of the sheets form an acute angle with the conveyor which angle faces the entrance end 32 of the apparatus.

When the outer forks 48 make an angle of about 90° with the bed of the conveyor and the support means 56 has not reached its proper position or if the stack is not in its correct position, cam switch CS-4 which coacts with cam CA-2 will close before electric eye switch LS-24 thereby causing the relief valves on cylinders C-9 and C-10 to open. When this occurs, the support means 56 retracts to thereby prevent its being ruptured or deformed.

Under normal conditions, when the outer forks 48 have traveled about 100°, cam switch CS-3 which coacts with cam CA-2 closes and cylinders C-3 and C-4 reverse direction to thereby retract outer forks 48 and close limit switch LS-8. If no sheets have fallen onto the conveyor, limit switch LS-14 will open and operations will continue.

Under normal conditions, when limit switch LS-8 closes, the fast speed of horizontal conveyor motor M-4 is actuated and clutches CL-2 are engaged. This permits the conveyor belts 60 and support means 56 to proceed at the same speed, say, about 90 feet per minute (FPM). At the same time, cylinders C-7 and C-8 are actuated to lower the entrance end of conveyor section 50 to its lowest position.

Conveyor section 50 is driven by motor M-6 and preferably comprises a plurality of belts 70. It should be noted that the exit of main conveyor 44 overlaps the entrance of conveyor section 50. The entrance 72 of conveyor 50 is movable by means of cylinders C-7 and C-8 among three positions. In the first position, entrance 72 is above the level of conveyor 44 to thereby preclude the movement of sheets from conveyor 44 onto conveyor section 50. In the second position, entrance 72 is below the level of conveyor 44 to thereby permit sheets from conveyor 44 to be moved rapidly onto conveyor section 50. In the third position, entrance 72 is level with conveyor 44 to enable both conveyors to move sheets from conveyor 44 through conveyor section 50 at a uniform speed.

If limit switches LS-9 and LS-14 are clear, the stack, with its sheets restings with their edges on the machine bed, proceeds forward until the leading edge of the stack reaches limit switch LS-9. If a stack has preceded the one arriving at switch LS-9, the trailing end of that stack will be at LS-9. When limit switch LS-9 closes, main conveyor motor M-4 stops. After the motor M-4 stops, the support means 56 pivots to about 100° causing the edge resting sheets to be pushed forward toward the inclined conveyor 52 and to close limit switch LS-10. If there is no preceding stack for the leading sheets on which to shingle, a small clump will form at the leading edge of the first stack. This clump must be cleared manually and the sheets must be arranged in shingled fashion by hand.

When switch LS-10 closes, the entrance 72 of conveyor section 50 is moved to its midposition wherein conveyor 44 and conveyor section 50 are aligned horizontally. The closing of switch LS-10 also disengages clutch Cl-2, starts motor M-7 to move inclined conveyor 52, starts motor M-4 at its slow speed, to move conveyor 44 at its slow speed, say, about 30 FPM, engages clutch Cl-1 and reverses motor M-5 to return support means 56 to its rest position near the entrance 32. When clutch CL-2 is disengaged the drive of the support means 56 is independent of that of the conveyor 44. The speed of conveyor 44 and inclined conveyor 52 is the same during this operational condition.

When the support means 56 returns to the starting or rest position, it closes limit switch LS-15 which stops motor M-5, disengages clutch CL-1, thereby stopping movement of conveyor 44, and operates cylinders C-9 and C-10 to thereby drop support bar 62 to its rest position and close switch LS-11.

When switch LS-11 closes, cylinders C-5 and C-6 operate to drop gates 42 if there is a following stack (stack 2) on the infeed conveyor 40 and if switch LS-12 is open. At this point the preceding stack (stack 1) should be clear of the main conveyor 44 and traveling toward the magazine or hopper 54. If it is not, the gates 42 remain up and closed until stack 1 clears the main conveyor and permits switch LS-12 to open.

When switch LS-12 opens and the previously described conditions are met, cylinders C-7 and C-8 move entrance 72 of conveyor section 50 to its upper position to preclude the entry of any more sheets onto section 50. With gates 42 down, stack 2 enters onto main conveyor 44 which is now driven by motor M-4 at its slow speed.

At the hopper 54, there are a pair of electric eye switches LS-16 and LS-17 and a reflector 80 at the opposite side of the hopper. Electric eye LS-17 is above electric eye LS-16 so that LS-17 senses a full hopper. If a full hopper is sensed, motor M-6, which drives conveyor section 50, stops as does motor M-7 which drives inclined conveyor 52. If stack 1 is still on conveyor 44, motor M-4 will also stop until the level of hopper 54 drops and electric eye LS-17 is clear.

Electric eye LS-16 senses the low level of sheets in the magazine 54. If the level falls below the desired value, a control is actuated to stop the operation of the following apparatus, e.g., a printer slotter. The printer-slotter remains off until a sufficient number of sheets are delivered to the magazine or hopper 54.

Motor M-8 is used to raise and lower inclined conveyor 52 to the desired level and motor M-9 is used to adjust the length of inclined conveyor 52 for ideal operation.

Motors M-1, M-2, M-10 and M-11 are preferably electric while motors M-4 through M-9 are preferably hydraulic. Motor M-11 supplies energy for running the hydraulic pump, shown diagrammatically as 51.

FIGS. 13–16 are diagrammatic views similar to FIGS. 1–6 showing the operation of an alternative embodiment of the invention which also supports the edge resting sheets with the acute angle facing the apparatus entrance. In particular, FIGS. 15 and 16 are analogous to FIGS. 3, 4 and 5. The numeral 100 designates the apparatus of these figures, generally. It is seen to have an entrance or entrance end 102 and an exit or exit end 104.

The stack of horizontal sheets 106 arrives at apparatus 100 on a customer's conveyor 108 or some similar delivery mechanism so that it can be readily moved onto an infeed conveyor 110. When a stack passes the gates 112, it enters upon a horizontal conveyor 114 the essential construction details of which will be described later. The stack moves along conveyor 114 until it reaches the upsetting position 115. At position 115, the conveyor stops and the stack is moved so that its edges rest on the bed of conveyor 114 in the desired faced orientation. This is accomplished by means of inner forks or slats 116 and outer forks or slats 118.

A conveyor section 120, similar to conveyor section 50, has its entrance overlapping the exit of conveyor 114 and is constructed so that its entrance 121 takes any of three positions. In the first position, the entrance 121 of conveyor section 120 is above the level of conveyor 114 to thereby preclude the entry of sheets onto section 120. In the second position, the entrance 121 is below the level of conveyor 114 to permit sheets to be moved onto section 120 rapidly and in the third position, the conveyor 114 and the conveyor section 120 are aligned horizontally to permit them to move in synchronism.

After the sheets ar singled toward the exit on conveyor section 120, they move up an inclined conveyor 122 and are then delivered to the exit 104 which is shown as a magazine or hopper 124. After the stack is upset so that the sheets rest on their edges, a support means 126, whose operation and construction will be described later, supports the stack so that the faces of the sheets and the bed of conveyor 114 form an acute angle facing entrance 102.

Turning next tto the more detailed Figures illustrating the embodiment of FIGS. 13–16, FIGS. 17 and 17A, joined on lines B-B, together form a side elevational view of this apparatus and FIG. 18 is a horizontal plan view thereof on a somewhat smaller scale. Support means 126 comprises a pair of spaced apart chains 128 between which there is mounted a support bar 130.

A description of the construction and operation of this embodiment of the invention follows. A stack of sheets 106 (stack A) is delivered on infeed conveyor 110 from customer's conveyor 108 and is detected by limit switch LS-122, located at the front edge of infeed conveyor 110, and infeed conveyor motor M-102 starts if there is no stack on infeed conveyor 110. As the trailing edge of stack A leaves conveyor 108, switch LS-123 opens thereby stopping conveyor 108. Stack A moves on infeed conveyor 110 until it is stopped by gates 112. Switches LS-101A and LS-101B aid in the squaring of the stack to the gates 112. When both limit switches LS-101A and LS-101B are closed, customer's conveyor 108 is started and stack B is brought up to LS-122 and conveyor 108 stops. At the same time infeed conveyor motor M-102 is also stopped. Using sensors LS-118 and LS-119, stack A is centered by means of motor M-101 which moves rollers 132 of conveyor 110 to the desired transverse position. To this end, rollers 132 are carried by a subframe **132*a* which is coupled to motor M-101 for transverse movement of the infeed conveyor 110 relative to conveyor 114 by means of a drive arrangement 132*b***.

After stack A is centered, gates 112, which are operated by cylinders C-105 and C-106, drop and motors M-104 and M-102 start. Motor M-104 drives conveyor 114 at its slow speed, say, about 30 FPM and motor M-102 drives the infeed conveyor 110. Stack A is thus moved onto conveyor 114 which comprises a plurality of belts 134. After the trailing edge of stack A clears the gates 112, switch LS-102 opens and gates 112 close and the infeed conveyor motor M-102 stops.

Stack A proceeds to the upsetting position 115 and when the stack's trailing edge clears switch LS-105 and it opens, motor M-4 stops and the movement of conveyor 114 stops. At the same time, cylinders C-101 and C-102 are actuated to raise inner or rear forks 116 toward the rear of stack A.

As inner forks 116 operated by cylinders C-101 and C-102 approach 75°, cam switch CS-101 closes actuating cylinders C-103 and C-104 to raise the outer forks 118 and causing cylinders C-101 and C-102 to reverse to thereby start the retraction of inner forks 116. When the outer forks 118 reach an angle of about 45°, cylinders C-103 an C-104 stop to thereby stop forks or slats 118 in place. At the same time inner forks or slats 116 continue to retract until they are fully retracted and switch LS-106 closes. At the same time, when outer forks 118 raise, switch LS-114 is closed to help detect stack upset.

When switch LS-106 closes, motor M-105 is started and chains 128 start to move counterclockwise, thereby carrying support bar 130 around until it is behind the upset stack. When support bar 130 reaches a position behind the stack, switch system LS-107 and LS-107A detects the condition and the outer forks 118 continue to move against the front of the stack until the stack is upset against support bar 130 so that the acute angle faces the apparatus entrance.

When the outer forks 118 reach an angle of about 90° and if support bar 130 has not reached a position at which it will support the trailing end of the stack or if the stack is not in the correct position, cam switch CS-104 will close before the electric eye LS-124 and motor M-105 will stop. After the outer forks 118 have traveled approximately 100° thereby pushing the stack against support bar 130 and actuating switch CS-102, the outer forks 118 retract to their rest position and close switch LS-108. Photocell 131 will detect the presence of sheets and will act to prevent the feeding of another stack onto conveyor 114 until the trailing sheets have cleared photocell 131. If no sheets have fallen onto the conveyor, LS-114 opens and operations will continue.

When LS-108 is contacted, motor M-104, which now moves the conveyor 114 at its fast speed, about 90 FPM, and motor M-105 is switched to the same speed so that the conveyor and support bar move in synchronism. At the same time the entrance 121 of conveyor section 120 drops to its lowest position so that the stack A can be moved onto section 120. If switches LS-109 and LS-114 are clear and LS-109 closes as the stack reaches it, motor M-104 is stopped and support bar 130 continues to move forward to thereby push the stack past the exit 123 of section 120 and against inclined conveyor 122. If there is no preceding stack to shingle onto, a small clump will form which must be cleared manually.

When the stack closes switch LS-110, motor M-106 raises the conveyor section entrance 121 to its midpositon and starts motor M-107 to move inclined conveyor 122. At the same time, motor M-104 turns on at its slow speed and moves conveyor 114 at its slow speed in synchronism with conveyor section 120 and inclined conveyor 122. The support bar continues to move until contactor 129 actuates switch LS-115 and turns off motor M-105 to stop movement of chains 128.

Stack A continues to go forward while the actuation of switch LS-115 signals gates 112 to open if another stack (stack B) is on the infeed conveyor. When stack A clears outer forks 118, switch LS-112 opens. Then entrance 121 of conveyor 120 raises and conveyor 114 runs at its slow speed. At the same time, gates 112 open to admit stack B to enter the main conveyor 114.

At the hopper 124, switches LS-116 and LS-117 operate in conjunction with reflector 125 in the same manner as do switches LS-16 and LS-17 and reflector 80. Cams CS-101 and CA-102 and cam switches CS-101, CS-102 and CS-103 operate in the same manner as cams CA-1 and CA-2 and cam switches CS-1, CS-2 and CS-3.

Motors M-101, M-102, M-110 and M-111 are electric motors and motors M-104 through M-109 are hydraulic motors. M-111 is the hydraulic pump motor which operates pump 125 for supplying power to the hydraulic motors. Motor M-108 is used to raise and lower inclined conveyor 122 and motor M-109 is used to adjust the length of inclined conveyor 122.

It should be understood that while the forks operate to deliver the shingled sheets in the same faced orientation at which they reach the apparatus, the invention will operate with equal facility on stacks on which the faced orientation of the sheets is reversed in the apparatus.

While particular embodiments of the apparatus of the invention have been shown and described, it is apparent to those skilled in the art that modifications are possible without departing from the spirit of the invention or the scope of the subjoined claims.

The embodiments of the invention in which an exclusive property or privilege is claimed are defined as follows:

1. The method of feeding sheets such as flat corrugated, paperboard sheets used to be formed into packaging cases from a stack of horizontal sheets into a horizontally shingled array of the desired faced orientation toward an exit such as a hopper which comprises:

feeding the stack of sheets onto the entrance of a conveyor;

tilting the stack of sheets to a first posture wherein they are resting on their edges so that the sheets form an acute angle with the conveyor, but are not in the horizontally shingled array;

supporting the face of the sheet in the stack which makes the acute angle with the conveyor to thereby support all the sheets on their edges in the first posture;

moving the sheets while supported on their edges in the first posture toward the exit; and subsequently dropping the sheets from the first posture and into a second posture wherein the sheets are in the horizontally shingled array on the conveyor shingled toward the exit to thereby deliver them to the exit.

2. The method of claim 1 wherein:

the acute angle formed by the sheets and the conveyor is toward the entrance of the conveyor.

3. The method of claim 2 including the following steps after the step of moving the sheets supported on their edges toward the exit:

precluding movement of the edge resting sheets from entering a portion of the conveyor until a predetermined condition of a previously fed stack of sheets has been reached;

rapidly moving the said precluded, edge resting sheets against the trailing sheet of the previously fed stack when the predetermined condition has been reached.

4. The method of claim 1 including the following steps after the step of moving the sheets supported on their edges toward the exit:

precluding movement of the edge resting sheets from entering a portion of the conveyor until a predetermined condition of a previously fed stack of sheets has been reached;

rapidly moving the said precluded edge resting sheets against the trailing sheet of the previously fed stack when the predetermined condition has been reached.

5. Apparatus having an entrance and an exit for feeding a stack of horizontal sheets to deliver the same toward the exit in a shingled fashion comprising:

a conveyor;

means for delivering the stack of horizontal sheets to the entrance and onto the conveyor;

means associated with the conveyor for moving the stack of horizontal sheets into a position in which the sheets form a group resting on the edges of the sheets and wherein one end of the group of sheets forms an acute angle with the conveyor such that the sheets forms an acute angle with the conveyor such that the sheets will be delivered to the exit in the desired faced orientation;

support means for supporting the group of sheets at the end thereof forming an acute angle with the conveyor to preclude the sheets from falling to a horizontal posture on the conveyor until a first predetermined condition has been reached;

moving means for moving the support means toward and away from the exit;

actuating means for actuating the moving means to move the support means toward the exit when the first predetermined condition has been reached to thereby move the group of sheets to a position wherein its leading sheet rests against the trailing sheet of the previous group and for actuating the moving means to move the support means toward the entrance when a second predetermined condition has been reached to await delivery of the next stack of horizontal sheets.

6. The apparatus of claim 5 wherein:

the acute angle formed by the group of sheets and the conveyor is toward the entrance.

7. The apparatus of claim 6 wherein:

the support means is a bar having two ends and being oriented transverse to the direction of motion of the conveyor.

8. The apparatus of claim 7 including:

a pair of longitudinally extending chains spaced from each other across the transverse dimension of the conveyor;

each end of the bar being operatively connected to one of the longitudinally extending chains;

the moving means being connected to the chains to thereby move the chains and the bar operatively connected thereto.

9. The apparatus of claim 8 wherein:

the longitudinally extending chains are endless and at least one half of the travel of each chain is below the level of the conveyor and including:

a pair of arms each having two ends, there being one arm connected at one end thereof to one end of the bar;

two blocks, the second end of each arm being connected to one of the blocks;

at least one idler and a clutch mounted on each block and engaged in the associated chain to enable the chain to be engaged and disengaged to thereby either move the block in synchronism with the conveyor or permit the block to be stationary as the conveyor moves;

the moving means moving the chains and blocks reciprocally toward and away from the exit when the clutches are engaged with the chains.

10. The apparatus of claim 9 including:

means for moving the bar between a first position in which it is below the level of the conveyor and a second position in which it is above the level of the conveyor and the sheets rest thereon to maintain an acute angle with the conveyor toward the entrance thereof.

11. The apparatus of claim 8 wherein:

the longitudinally extending chains are of the endless type and are above the level of the conveyor;

each end of the bar being connected to one of the chains;

the moving means moving the chains in a single direction such that the bar moves toward the exit during a first portion of its travel when it is in contact with the sheets and toward the entrance during a second portion of its travel when it is out of contact with the sheets.

12. The apparatus of claim 11 including:

a conveyor section between the entrance and exit beyond the point at which the stack of sheets is upset to be resting on their edges on the conveyor;

said conveyor section being movable among a first position in which its entrance end is above the level of the conveyor to thereby preclude entry of sheets thereupon, a second position in which its entrance end is below the level of the conveyor to thereby permit the sheets to be pushed thereon and a third position in which its entrance end is at the level of the conveyor to thereby permit the sheets to move along the conveyor section.

13. The apparatus of claim 10 including:

a conveyor section between the entrance and exit beyond the point at which the stack of sheets is upset to be resting on their edges on the conveyor;

said conveyor section being movable among a first position in which its entrance end is above the level of the conveyor to thereby preclude entry of sheets thereupon, a second position in which its entrance end is below the level of the conveyor to thereby permit the sheets to be moved rapidly thereon and a third position in which its entrance end is at the level of the conveyor to thereby permit the sheets to move along the conveyor section in synchronism therewith.

14. The apparatus of claim 9 including:

a conveyor section between the entrance and exit beyond the point at which the stack of sheets is upset to be resting on their edges on the conveyor;

said conveyor section being movable among a first position in which its entrance end is above the level of the conveyor to thereby preclude entry of sheets thereupon, a second position in which its entrance end is below the level of the conveyor to thereby permit the sheets to be moved rapidly thereon and a third position in which its entrance end is at the level of the conveyor to thereby permit the sheets to move along the conveyor section in synchronism therewith.

15. The apparatus of claim 8 including:

a conveyor section between the entrance and exit beyond the point at which the stack of sheets is upset to be resting on their edges on the conveyor;

said conveyor section being movable among a first position in which its entrance end is above the level of the conveyor to thereby preclude entry of sheets thereupon, a second position in which its entrance end is below the level of the conveyor to thereby permit the sheets to be moved rapidly thereon and a third position in which its entrance end is at the level of the conveyor to thereby permit the sheets to move along the conveyor section in synchronism therewith.

16. The apparatus of claim 7 including:

a conveyor section between the entrance and exit beyond the point at which the stack of sheets is upset to be resting on their edges on the conveyor;

said conveyor section being movable among a first position in which its entrance end is above the level of the conveyor to thereby preclude entry of sheets thereupon, a second position in which its entrance end is below the level of the conveyor to thereby permit the sheets to be moved rapidly thereon and a third position in which its entrance end is at the level of the conveyor to thereby permit the sheets to move along the conveyor section in synchronism therewith.

17. The apparatus of claim 6 including:

a conveyor section between the entrance and exit beyond the point at which the stack of sheets is upset to be resting on their edges on the conveyor;

said conveyor section being movable among a first position in which its entrance end is above the level of the conveyor to thereby predluce entry of sheets thereupon, a second position in which its entrance end is below the level of the conveyor to thereby preclude entry of sheets thereupon, a second position in which its entrance end is below the level of the conveyor to thereby permit the sheets to be moved rapidly thereon and a third position in which its entrance end is at the level of the conveyor to thereby permit the sheets to move along the conveyor section in synchronism therewith.

18. The apparatus of claim 5 including:

a conveyor section between the entrance and exit beyond the point at which the stack of sheets is upset to be resting on their edges on the conveyor;

said conveyor section being movable among a first position in which its entrance end is above the level of the conveyor to thereby preclude entry of sheets thereupon, a second position in which its entrance end is below the level of the conveyor to thereby permit the sheets to be moved rapidly thereon and a third position in which its entrance end is at the level of the conveyor to thereby permit the sheets to move along the conveyor section in synchronism therewith.

19. The apparatus of claim 18 including:

means at the entrance having a first position in which the stack is precluded from entry onto the conveyor and a second position in which the stack may enter upon the conveyor.

20. The apparatus of claim 17 including:
means at the entrance having a first position in which the stack is precluded from entry onto the conveyor and a second position in which the stack may enter upon the conveyor.

21. The apparatus of claim 16 including:
means at the entrance having a first position in which the stack is precluded from entry onto the conveyor and a second position in which the stack may enter upon the conveyor.

22. The apparatus of claim 15 including:
means at the entrance having a first position in which the stack is precluded from entry onto the conveyor and a second position in which the stack may enter upon the conveyor.

23. The apparatus of claim 14 including:
means at the entrance having a first position in which the stack is precluded from entry onto the conveyor and a second position in which the stack may enter upon the conveyor.

24. The apparatus of claim 13 including:
means at the entrance having a first position in which the stack is precluded from entry onto the conveyor and a second position in which the tack may enter upon the conveyor.

25. The apparatus of claim 12 including:
means at the entrance having a first position in which the stack is precluded from entry onto the conveyor and a second position in which the stack may enter upon the conveyor.

26. The apparatus of claim 11 including:
means at the entrance having a first position in which the stack is precluded from entry onto the conveyor and a second position in which the stack may enter upon the conveyor.

27. The apparatus of claim 10 including:
means at the entrance having a first position in which the stack is precluded from entry onto the conveyor and a second position in which the stack may enter upon the conveyor.

28. The apparatus of claim 9 including:
means at the entrance having a first position in which the stack is precluded from entry onto the conveyor and a second position in which the stack may enter upon the conveyor.

29. The apparatus of claim 8 including:
means at the entrance having a first position in which the stack is precluded from entry onto the conveyor and a second position in which the stack may enter upon the conveyor.

30. The apparatus of claim 7 including:
means at the entrance having a first position in which the stack is precluded from entry onto the conveyor and a second position in which the stack may enter upon the conveyor.

31. The apparatus of claim 6 including:
means at the entrance having a first position in which the stack is precluded from entry onto the conveyor and a second position in which the stack may enter upon the conveyor.

32. The apparatus of claim 5 including:
means at the entrance having a first position in which the stack is precluded from entry onto the conveyor and a second position in which the stack may enter upon the conveyor.

* * * * *